US009335129B1

(12) United States Patent
Perciballi

(10) Patent No.: US 9,335,129 B1
(45) Date of Patent: May 10, 2016

(54) ARMOR COMPOSITE WITH EXPANSIBLE ENERGY ABSORBING LAYER

(71) Applicant: William J. Perciballi, Phoenix, AZ (US)

(72) Inventor: William J. Perciballi, Phoenix, AZ (US)

(73) Assignee: Armorworks Enterprises LLC, Chandler, AZ (US)

( * ) Notice: Subject to any disclaimer, the term of this patent is extended or adjusted under 35 U.S.C. 154(b) by 108 days.

(21) Appl. No.: 14/282,794

(22) Filed: May 20, 2014

Related U.S. Application Data

(60) Provisional application No. 61/825,409, filed on May 20, 2013.

(51) Int. Cl.
*F41H 5/04* (2006.01)

(52) U.S. Cl.
CPC ..... *F41H 5/0464* (2013.01)

(58) Field of Classification Search
CPC ..... F41H 5/00; F41H 5/04; F41H 5/0442; F41H 5/0457
USPC ..... 89/36.02, 36.05, 904, 910, 912, 921, 89/922
See application file for complete search history.

(56) References Cited

U.S. PATENT DOCUMENTS 2,733,177 A * 1/1956 Meyer ..... F41H 5/045 428/49
3,969,563 A * 7/1976 Hollis, Sr. ..... B32B 3/28 220/62.11
4,404,889 A * 9/1983 Miguel ..... F41H 5/0442 428/118
4,857,119 A * 8/1989 Karst ..... C21D 9/42 109/78
5,200,256 A * 4/1993 Dunbar ..... B32B 15/14 109/49.5
5,349,893 A * 9/1994 Dunn ..... F41H 5/04 2/2.5
5,804,757 A * 9/1998 Wynne ..... F41H 5/0428 2/2.5
6,568,310 B2 * 5/2003 Morgan ..... F41H 5/0457 244/118.5
6,698,331 B1 3/2004 Yu et al.
8,297,177 B2 10/2012 Schulte
2004/0216595 A1 11/2004 Dickson
2012/0060676 A1 3/2012 Kidd et al.

FOREIGN PATENT DOCUMENTS

WO WO 8908233 A1 * 9/1989 ..... F41H 5/0457

* cited by examiner

*Primary Examiner* — Jonathan C Weber
(74) *Attorney, Agent, or Firm* — James L Farmer

(57) ABSTRACT

Designs and methods are provided for a hard armor panel with enhanced energy absorption. In one embodiment the hard armor panel includes a rigid strike plate having a front side and a back side, the front side facing an anticipated ballistic threat; and a consolidated ballistic fabric backing also having a front side and a back side, the front side of the ballistic fabric backing adhered to the back side of the rigid strike plate. The armor panel may further include an energy absorbing layer attached to or incorporated within the hard armor panel, wherein the energy absorbing layer is made of a deformable material configured with an energy absorbing pattern.

17 Claims, 4 Drawing Sheets

FIG. 2
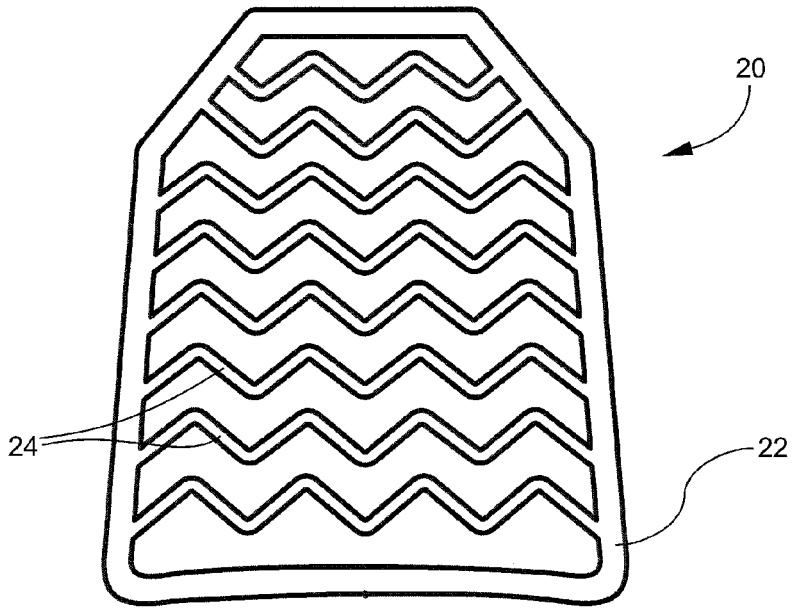
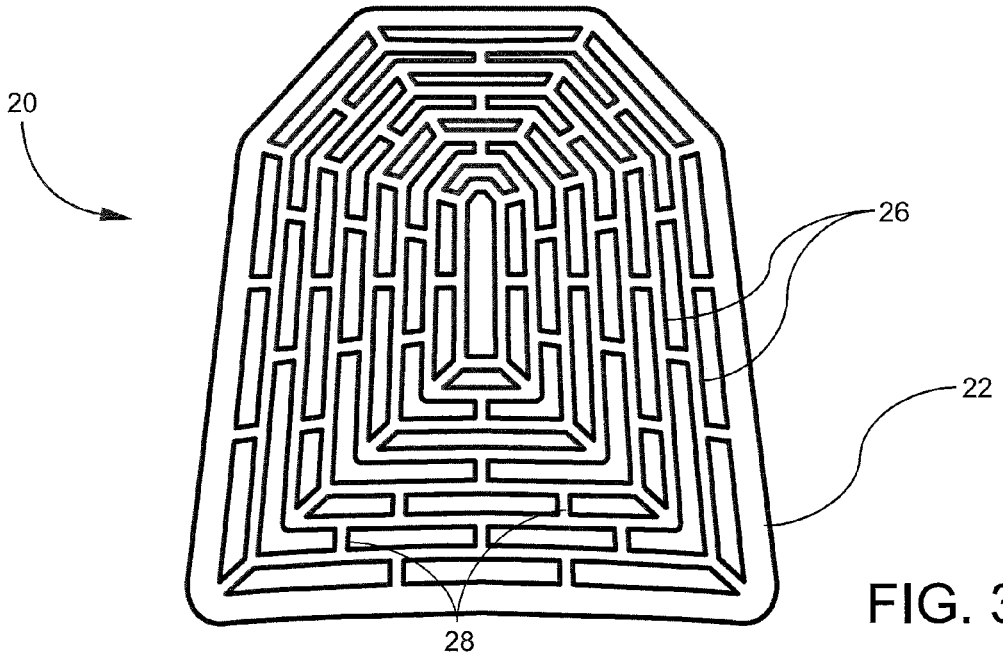
FIG. 3

ARMOR COMPOSITE WITH EXPANSIBLE ENERGY ABSORBING LAYER

The technical field of the present invention generally relates to ballistic armor. Provisional Patent Application Ser. No. 61/825,409, to which the present application claims priority, is hereby incorporated by reference in its entirety.

TECHNICAL FIELD

Brief Description of the Drawings

In the accompanying drawings:

FIGS. 2 and 3 are plan views of expansible energy absorbing layers for use in conjunction with an armor plate such as that of FIG. 1;

DESCRIPTION OF THE EMBODIMENTS

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
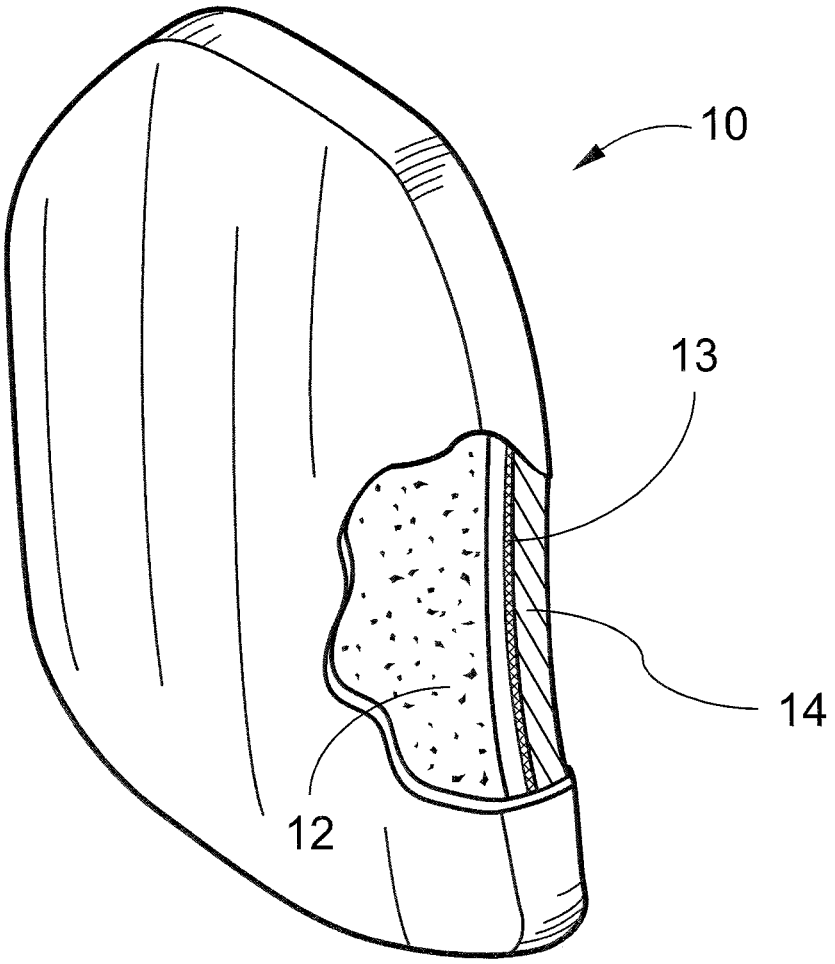
FIG. 1 Prior Art
FIG. 1 is a prior art armor plate in the configuration of a Small Arms Protective Insert (SAPI)

Referring now to the drawing Figures, a hard armor composite is indicated generally at reference numeral 10. Armor composite 10 is an example of a well known multi-layer structure typically used in various hard armor applications, such as body armor plates, vehicle armor, and the like. The particular composite armor plate 10 shown in FIG. 1 represents a type of body armor plate known in the industry as a Small Arms Protective Insert (SAPI), and comprises generally a hard strike plate 12, an adhesive layer 13, and a consolidated ballistic fabric baking 14. Various examples of composite armor adopting this general type of construction are described in greater detail in U.S. Pat. Nos. 5,437,905, 5,635,288, 5,935,678, 5,443,883, 5,547,536, 6,408,733, 7,549,366, 7,827,898, 8,065,947, 7,845,265, 7,148,162, the entire contents of which are all hereby incorporated by reference.

FIGS. 2 and 3 depict two embodiments of an expansible energy absorbing layer for use in conjunction with a hard armor construction such as that of FIG. 1. For convenience the expansible energy absorbing layers shown are again in the shape of a SAPI, however the energy absorbing layers may take any shape needed for a particular armor panel. Both embodiments comprise a layer of a deformable material configured with an energy absorbing pattern. The type and thickness of material used, as well as the design of the energy absorbing pattern may vary depending upon the particular application and the anticipated ballistic threat level. For example, the layer 20 may be formed from sheet metal, and patterned by a punching or cutting process. Suitable sheet metals may include for example steel, stainless steel, copper, aluminum, and other metals with greater than 3% elongation to failure. Alternatively the layer 20 may be constructed of various composite materials, such as carbon or graphite composite, fiberglass, and the like. In one embodiment the material is a composite having dissimilar composition, or dissimilar mechanical properties, such as stiffness and strength, to those of the consolidated fabric backing or the strike plate of a particular armor panel.

Referring first to FIG. 2, an exemplary expansible layer 20 has a perimeter frame 22, and a series of spaced apart energy absorbing links 24 spanning the frame 22 from one side to the other. In the depicted embodiment the links 24 have a repeating "w" or "zig-zag" type pattern, although other repeating patterns such as a square wave or sinusoidal shape may be effectively used instead.

The pattern of the embodiment shown in FIG. 3 also includes a perimeter frame 22, however rather than separate links extending across the frame, the perimeter frame 22 is repeated in a series of progressively smaller, spaced apart, interior frames 26 connected together by bridges 28. The positions of bridges 28 are staggered, such that the bridges on one side of a frame 26 do not align with the bridges on the other side. Thus in both embodiments shown there is no straight line path across the layer from one side of the perimeter frame to the other. Instead, an energy absorbing pattern in accordance with the present disclosure defines a plurality of circuitous and/or repetitive paths, each one longer than a straight line path across the expansible layer.

In addition to the embodiments of FIGS. 2 and 3, the energy absorbing pattern may comprise simply a mesh or fabric of woven metal wires, similar for example to aluminum window screen. Such a metal mesh layer may be fabricated from any of the metals listed above in reference to the earlier embodiments, and may or may not include a perimeter frame. Specific design parameters such as the type of weave, wire spacing, and wire diameter may again vary as required to meet the needs of a particular application. Similar to the embodiment of FIG. 2, each individual wire of the mesh serves as an energy absorbing link that traces a circuitous, repetitive path across the expansible layer.

Figure 4:
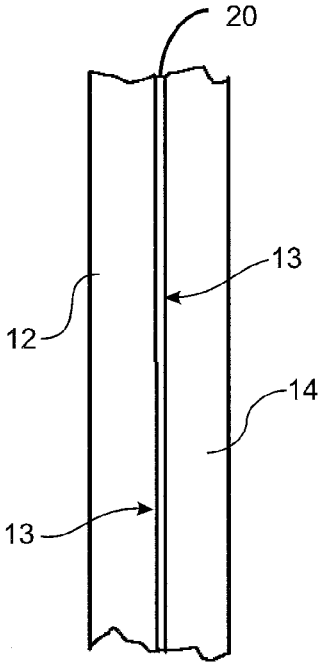
FIGS. 4 through 6 are cross sections of an armor plate incorporating one or more expansible energy absorbing layers on or within the consolidated fabric backing.
Figure 5:
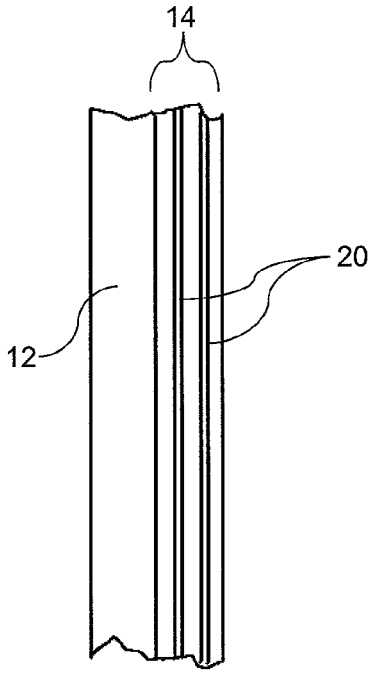
Figure 6:
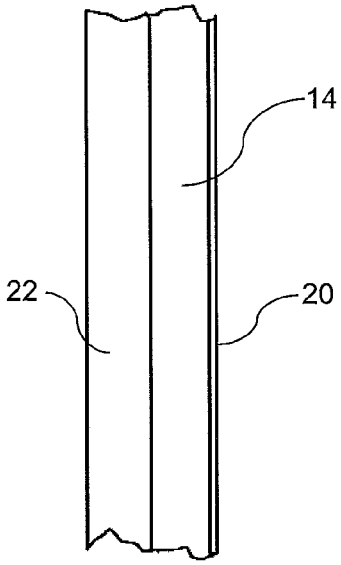

The expansible layer 20 may be incorporated in a hard armor structure in various ways. For example, referring to FIG. 4, an expansible layer 20 may be sandwiched between a strike plate 12 and fabric backing 14 using an adhesive material or layer 13 on either side of layer 20. The layer of FIG. 4 may be used in combination with another expansible layer on the front face of the strike plate 12 (not shown) to sandwich the strike plate between two expansible layers. One or more expansible layers 20 may also be built into the fabric backing 14 as shown in FIG. 5, or attached to the back of the fabric backing as shown in FIG. 6. Moreover, any of the above described constructions may be used alone or in combination with each other in any number of configurations as may be warranted by the particular application.

Figure 7:
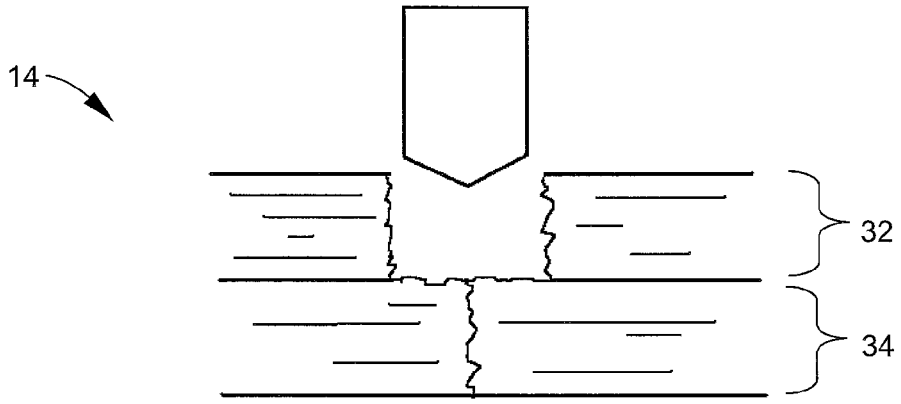
FIG. 7 is a cross-sectional representation of a consolidated fabric backing portion of an armor panel, illustrating the shear and tensile failure zones.

In one particular embodiment, the expansible layer is located within the fabric backing 14 at a position defined relative to a transition or interface between two distinct failure modes in the backing. Referring to FIG. 7, a fabric backing 14 is designed to respond to a defined ballistic projectile impact with a combination of shear and tensile failure of the fibers. In particular, the fabric backing comprises a shear failure zone 32 extending partially through the backing from the side facing the incoming projectile threat, and a tensile failure zone 34 extending through the remainder of the backing to the opposite side. In the shear failure zone 32, the backing fibers fail in shear as the projectile cuts a path through the backing. The shearing occurs at the perimeter of the projectile to produce a "two-sided" failure when viewed in cross section, i.e. one shear failure at each edge of the projectile. In the tensile failure zone 34, the remaining projectile energy is by definition not sufficient to cause fiber shearing, but sufficient to tear the fibers in tension. The result is a single point failure in the tensile failure zone that occurs in front of the projectile rather than at the projectile perimeter.

While the tearing of fibers in the tensile failure zone 34 absorbs projectile energy, the fibers in such fabric backings are typically highly inelastic, and generally inefficient energy absorbers. In addition, such fiber composites are normally made with unidirectional, non-woven fibers. Thus there is relatively little fiber stretch prior to rupture, and as a result, relatively few fibers resisting the momentum of the projectile at any point in time. The present inventor has recognized and identified this phenomenon as a weakness in the energy absorption capability of a typical fabric backing, and further recognized that the energy absorption capability may be enhanced by incorporating an expansible energy absorbing layer proximate to, or within the tensile failure zone 34.

Figure 8:
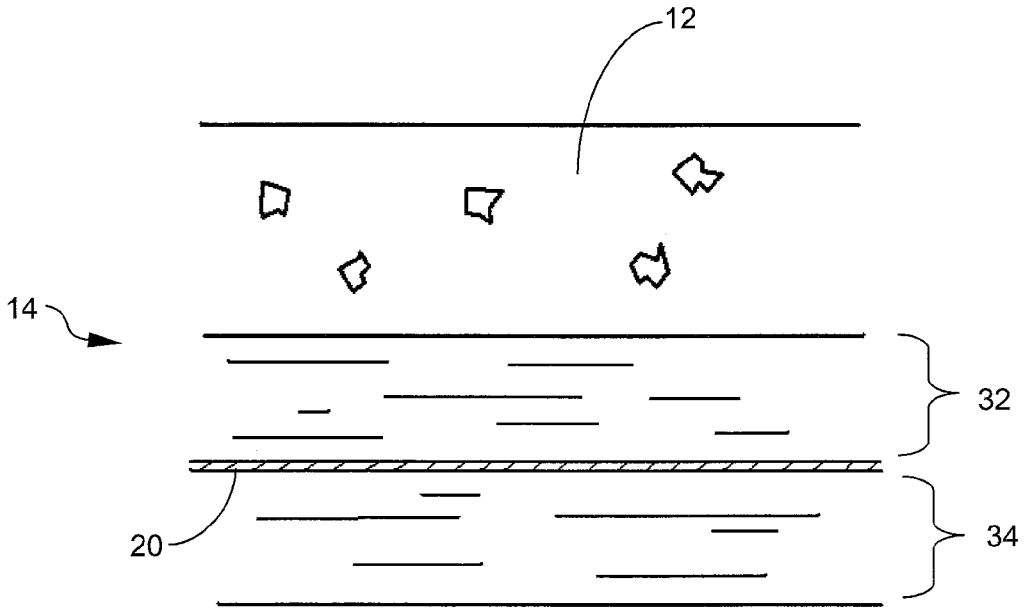
FIG. 8 is a cross-section representation of an armor panel with an expansible energy absorbing player positioned at the interface between the shear and tensile failure zones of the fabric backing portion of the panel.

For example, in one embodiment shown in FIG. 8, an expansible layer 20 is located precisely at the interface between the shear failure zone 32 and tensile failure zone 34. The expansible layer is able to deform without rupturing to a greater extent than the adjacent backing material, thereby increasing the overall energy absorption capacity. Depending upon the needs of a particular application, one or more expansible layers may also be incorporated within the tensile failure zone 34, in addition to (or instead of) a layer at the transition interface. Moreover, improving the energy absorbing capability of the fabric backing by incorporating one or more expansible layers translates directly to increased stopping power and reduced back-face deformation, both critical measures of armor effectiveness.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. A hard armor panel, comprising:

a rigid strike plate having a front side and a back side, the front side facing an anticipated ballistic threat;

a consolidated ballistic fabric backing having a front side and a back side, the front side adhered to the back side of the rigid strike plate; and an energy absorbing layer incorporated within the consolidated ballistic fabric backing at a depth corresponding to a predetermined transition from a shear failure zone to a tensile failure zone, the energy absorbing layer comprising a deformable material configured with an energy absorbing pattern.

2. The hard armor panel of claim 1, wherein energy absorbing layer is patterned sheet metal, and the energy absorbing pattern defines a plurality of contiguous sheet metal paths extending across the layer.

3. The hard armor panel of claim 2, wherein any of the contiguous sheet metal paths extending across the layer from a first point at one perimeter edge of the layer to a second point at another perimeter edge of the layer is longer than a straight line between the same two points.

4. The hard armor panel of claim 3, wherein the energy absorbing layer comprises a perimeter frame portion, and a series of spaced apart energy absorbing links spanning the perimeter frame portion from one side to the other.

5. The hard armor panel of claim 1, wherein the energy absorbing layer comprises a mesh of woven metal wires.

6. The hard armor panel of claim 1, wherein the energy absorbing layer is made of a material selected from the group consisting of aluminum, copper, steel, and stainless steel.

7. The hard armor panel of claim 6, wherein the energy absorbing layer is made of a metal with greater than three percent elongation to failure.

8. The hard armor panel of claim 1, further comprising a second energy absorbing layer disposed within the consolidated ballistic fabric backing.

9. A hard armor panel, comprising:

a rigid strike plate having a front side and a back side, the front side facing an anticipated ballistic threat;

a consolidated ballistic fabric backing having a front side and a back side, the front side adhered to the back side of the rigid strike plate; and a first energy absorbing layer comprising a deformable material configured with an energy absorbing pattern, wherein the first energy absorbing layer is positioned within the consolidated ballistic fabric backing at a depth corresponding to a tensile failure zone proximate a predetermined transition from a shear failure zone to the tensile failure zone.

10. The hard armor panel of claim 9, wherein the first energy absorbing layer is patterned sheet metal, and the energy absorbing pattern defines a plurality of contiguous sheet metal paths extending across the layer.

11. The hard armor panel of claim 10, wherein any of the contiguous sheet metal paths extending across the first energy absorbing layer from a first point at one perimeter edge of a layer to a second point at another perimeter edge of the layer is longer than a straight line between the same two points.

12. The hard armor panel of claim 11, wherein the first energy absorbing layer comprises a perimeter frame portion, and a series of spaced apart energy absorbing links spanning the perimeter frame portion from one side to the other.

13. The hard armor panel of claim 9, further comprising a second energy absorbing layer disposed between the strike plate and the consolidated ballistic fabric backing.

14. A small arms protective insert, comprising:

a contoured ceramic strike plate having a front side and a back side, the front side facing an anticipated ballistic threat;

a consolidated ballistic fabric backing having a front side and a back side, the front side adhered to the back side of the strike plate; and an energy absorbing layer positioned within the consolidated ballistic fabric backing at a depth corresponding to a tensile failure zone proximate a predetermined transition from a shear failure zone to the tensile failure zone, the energy absorbing layer comprising a deformable material configured with an energy absorbing pattern.

15. The small arms protective insert of claim 14, wherein energy absorbing layer is patterned sheet metal, and the energy absorbing pattern defines a plurality of contiguous sheet metal paths extending across the layer.

16. The small arms protective insert of claim 15, wherein any of the contiguous sheet metal paths extending across the layer from a first point at one perimeter edge of the layer to a second point at another perimeter edge of the layer is longer than a straight line between the same two points.

17. The small arms protective insert of claim 16, wherein the energy absorbing layer comprises a perimeter frame portion, and a series of spaced apart energy absorbing links spanning the perimeter frame portion from one side to the other.

* * * * *